US006875064B2

(12) United States Patent
Westhoff et al.

(10) Patent No.: US 6,875,064 B2
(45) Date of Patent: Apr. 5, 2005

(54) REVERSE GATE FOR A WATERCRAFT

(75) Inventors: Paul E. Westhoff, Kenosha, WI (US); Mark Whiteside, Zion, IL (US)

(73) Assignee: Bombardier Recreational Products Inc., Valcourt (CA)

( * ) Notice: Subject to any disclaimer, the term of this patent is extended or adjusted under 35 U.S.C. 154(b) by 0 days.

(21) Appl. No.: 10/605,618

(22) Filed: Oct. 14, 2003

(65) Prior Publication Data

US 2004/0253885 A1 Dec. 16, 2004

Related U.S. Application Data

(60) Provisional application No. 60/478,389, filed on Jun. 13, 2003.

(51) Int. Cl.[7] ..... B63H 11/00
(52) U.S. Cl. ..... 440/41
(58) Field of Search ..... 440/40, 41, 42, 440/43

(56) References Cited

U.S. PATENT DOCUMENTS

| | | | | |
|---|---|---|---|---|
| 3,114,239 A | * | 12/1963 | Aylor | 60/221 |
| 3,945,201 A | | 3/1976 | Entringer | |
| 4,026,235 A | | 5/1977 | Woodfill | |
| 4,223,630 A | | 9/1980 | Keeney | |
| 4,315,749 A | | 2/1982 | Baker et al. | |
| 4,509,923 A | * | 4/1985 | Turnbull | 440/43 |
| 5,720,636 A | | 2/1998 | Burg | |
| 5,752,864 A | | 5/1998 | Jones et al. | |
| 5,755,601 A | | 5/1998 | Jones | |
| 6,024,614 A | | 2/2000 | Burg | |
| 6,224,436 B1 | | 5/2001 | Westhoff et al. | |
| 6,227,919 B1 | | 5/2001 | Blanchard | |
| 6,244,914 B1 | | 6/2001 | Freitag et al. | |
| 6,428,370 B1 | | 8/2002 | Jones | |
| 6,533,623 B2 | | 3/2003 | Simard et al. | |
| 6,547,611 B1 | | 4/2003 | Boroos et al. | |
| 2002/0028614 A1 | | 3/2002 | Simard et al. | |
| 2002/0028615 A1 | | 3/2002 | Simard et al. | |

FOREIGN PATENT DOCUMENTS

| | | |
|---|---|---|
| EP | 0 201 657 | * 11/1986 |
| JP | 6-191486 | * 7/1994 |

* cited by examiner

*Primary Examiner*—Sherman Basinger
(74) *Attorney, Agent, or Firm*—BRP Legal Services

(57) ABSTRACT

A system and method for constructing a reverse gate for a watercraft is disclosed. The reverse gate is independently rotatable relative to a watercraft and a steering nozzle and includes at least two curved surfaces. The curved surfaces are attached to one another to form an apex that is offset from a midpoint of the reverse gate and the reverse gate is attached to the watercraft so that the apex is also offset from a center axis of a steering nozzle oriented relative thereto. Water discharged from the steering nozzle can be diverged at the apex of the reverse gate to provide lateral and reverse thrust to the watercraft. The reverse gate includes an additional curved section contained within one of the at least two curved sections to provide improved lateral thrust to the watercraft.

16 Claims, 11 Drawing Sheets

REVERSE GATE FOR A WATERCRAFT

CROSS REFERENCE TO RELATED APPLICATIONS

The present application claims the benefit of U.S. Ser. No. 60/478,389 filed Jun. 13, 2003.

BACKGROUND OF INVENTION

The present invention relates generally to marine propulsion systems, and more particularly, to a reverse gate for a twin jet drive marine propulsion system.

Marine vessels can be equipped with a variety of propulsion systems. One such system is a water jet. A water jet system intakes water from a body of water and propels it from a generally aft position of the vessel. The propulsion of water provides the motive force to the watercraft. Water jet systems generally include an engine, a stationary nozzle, an impeller, a steering nozzle, and some form of a reverse gate. A twin jet drive system generally includes two such systems.

The steering nozzle is generally pivotably attached to the stationary nozzle or a fixed portion of the watercraft and provides directional discharge therefrom. The directional discharge is controlled by an operator and facilitates steering of the vessel when the vessel is operated in a forward direction. A reverse gate is generally pivotally attached to the steering nozzle and rotates relative thereto. Reverse gates typically redirect water from the steering nozzle in a downward and forward direction.

The forward discharge of water from the reverse gate provides a neutral and/or reverse thrust to the watercraft. When a forward direction of travel is desired, the reverse gate is generally positioned in an inoperative position. The inoperative position is generally defined as having the reverse gate removed from the discharge flow of the steering nozzle. When a reverse or neutral direction of travel is desired, the reverse gate is rotated to redirect the flow from the steering nozzle either under the vessel or into a vertical plane. Neutral direction of travel is achieved by redirecting a portion of the flow discharged from the steering nozzle such that the reverse gate generates a reverse thrust that is substantially similar to the forward thrust generated by the portion of the flow not redirected by the reverse gate. Reverse is achieved by rotating the reverse gate further into the discharge flow from the steering nozzle so that the net thrust is in the reverse direction. Such redirection of flow from the steering nozzle effectively slows and/or reverses the direction of travel of the watercraft.

Steering of the watercraft, when in reverse or neutral, is accomplished by rotation of the steering nozzle with the reverse gate attached thereto. Such a construction requires complex linkage mechanisms to accommodate the two planes of rotation of the reverse gate relative to the watercraft. Additionally, having the steering nozzle and the reverse gate attached to one another requires that the reverse gate be removed in order to remove the steering nozzle from the vessel. Reverse gates that redirect the discharge from the steering nozzle under the vessel, or in a vertical direction, are also inefficient for steering of the watercraft when in the reverse or neutral travel directions. These systems may be advantageous to stopping a watercraft, however, they are inefficient for steering of the vessel in reverse directions.

Reverse gates are typically designed for operation in watercraft with single jets and are not optimized for twin jet installations. Particularly, in twin jet watercraft equipped with reverse gates that are secured thereto independent of the steering nozzle, a significant portion of the flow is not used effectively. That is, there can be an interference between the inboard portion of the reverse flow and the transom of the boat. This interference also creates inefficiencies in the neutral and reverse operating conditions of a watercraft so equipped.

It would therefore be desirable to design a system and method capable of providing a reverse gate for a twin jet watercraft so that the reverse gate is secured thereto independent of the steering nozzle and wherein the reverse gate provides both improved reverse thrust and steering for reverse operation of the watercraft.

BRIEF DESCRIPTION OF INVENTION

The present invention is directed to a reverse gate for a jet propelled watercraft that solves the aforementioned problems. The present invention provides a reverse gate that is rotatably attached to a watercraft such that the reverse gate can be rotated into a flow discharged from a steering nozzle. The reverse gate is attached to the watercraft such that the position of the reverse gate relative to the watercraft is independent of the position of the steering nozzle. The reverse gate includes an apex that is offset from a center of the gate and is constructed to generate variable lateral thrusts therefrom. The position of the steering nozzle relative to the reverse gates determines the cumulative lateral thrust exerted on the watercraft and provides reverse steering thereto.

Therefore, in accordance with one aspect of the present invention, a reverse gate includes a first scoop having an inlet and an outlet and a second scoop also having an inlet and an outlet. The inlet of the first scoop intersects the inlet of the second scoop and forms an apex thereat. The apex is offset from a center of the reverse gate and thereby discharges a proportional amount of the water that impinges thereupon from a steering nozzle.

In accordance with another aspect of the present invention, a reverse gate assembly for a watercraft includes a steering nozzle pivotably attached to the watercraft and having a center axis therethrough. The reverse gate includes a first curved section and a second curved section attached thereto and a divider located between the first and the second curved sections. The divider is offset from the center axis of the steering nozzle. The first curved section produces a first discharge of water that is greater than a second discharge of water from the second curved section when the steering nozzle is oriented normal to the reverse gate.

In accordance with a further aspect of the present invention, a jet-propulsion system of a watercraft includes a steering nozzle rotatably attached to a first outlet. A reverse gate is attached to the first outlet and includes an apex that is offset from a midpoint of the reverse gate and a center of the steering nozzle such that more water is directed towards the midpoint of the reverse gate when the steering nozzle is oriented perpendicular thereto thereby exerting lateral thrust on the watercraft.

In accordance with yet another aspect of the present invention, a method of providing a steering control to a watercraft is disclosed which includes, providing a reverse gate in a flow from a steering nozzle, separating the flow across the reverse gate into a first and second flow, and directing the first flow in a direction generally opposite to the flow from the steering nozzle when the steering nozzle is generally perpendicular to the reverse gate. The second flow is redirected by the reverse gate in a second direction generally perpendicular to the flow from the steering nozzle and; wherein the first flow is generally greater than the second flow when the steering nozzle is generally perpendicular to the reverse gate.

In accordance with a further aspect of the present invention, a reverse gate includes a first scoop having an inlet and an outlet and a second scoop also having an inlet and an outlet. The inlet of the first scoop intersects the inlet of the second scoop and forms an apex thereat. A mounting arrangement mounts the reverse gate about a nozzle so that the apex of the reverse gate is offset relative to the nozzle that the reverse gate is mounted to. Such a construction divides a flow impinged on the reverse gate into a first, lateral and reverse, component, and a second, primarily lateral, component.

Various other features, objects and advantages of the present invention will be made apparent from the following detailed description and the drawings.

BRIEF DESCRIPTION OF DRAWINGS

The drawings illustrate one preferred embodiment presently contemplated for carrying out the invention.

In the drawings.

DETAILED DESCRIPTION

Figure 1:
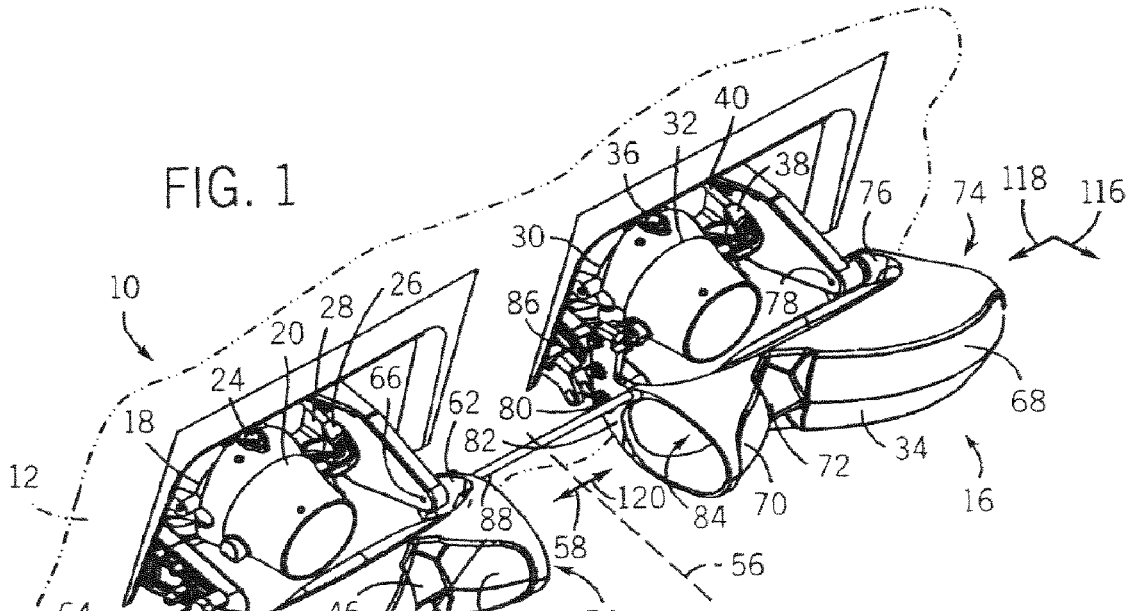
FIG. 1 is a perspective view of a watercraft jet assembly according to the present invention.

FIG. 1 shows a stern section 12 of a watercraft 10 having a pair of jet assemblies 14, 16 which protrude from stern section 12 and generate a water jet that propels watercraft 10 through a water body such as a lake. Jet assembly 14 includes a stator nozzle 18, a steering nozzle 20, and a reverse gate 22. Stator nozzle 18 extends from stern section 12 of watercraft 10 and directs water flow into steering nozzle 20. A pivot joint 24 connects steering nozzle 20 to stator nozzle 18 and allows for rotation therebetween. Steering nozzle 20 also include a control arm 26 adapted to be connected to a steering linkage 28. Steering linkage 28 is constructed to be connected to an operator input, such as a steering wheel, and effectuate the rotation of steering nozzle 20 about pivot joint 24 relative to stator nozzle 18. The rotation of steering nozzle 20 provides an operator with the ability to control the direction of travel of the watercraft when traveling in a generally forward direction. Reverse gate 22 is disposed aft of the steering nozzle 20 and is pivotably connected to watercraft 10 so that it can be rotated into a discharge of water from steering nozzle 20 and provide a reverse thrust to the watercraft, as will hereinafter be described in more detail.

Similar to the description above, jet assembly 16 also includes a stator nozzle 30, a steering nozzle 32, and a reverse gate 34. Steering nozzle 32 is pivotably connected to stator nozzle 30 about a pivot joint 36 and also includes a control arm 38. Control arm 38 also includes a steering linkage 40 interconnected to steering linkage 28 of jet assembly 14 such that an operator input, such as the turning of a steering wheel, controls the rotation of both steering nozzles 20, 32 relative to stator nozzles 18, 30, respectively. It is envisioned that such linkage could be mechanical, hydraulic, electrical, or any combination thereof. As such, steering nozzles 20, 32 rotate in unison as a result of a single operator controlled input.

Reverse gate 22 of jet assembly 14 includes a first scoop 42 and a second scoop 44 which are connected at an apex 46 or divider. First scoop 42 extends from apex 46 to an opening 48 which directs a flow therethrough partially towards watercraft 10. The scoop shape of the first and second scoops is formed by curving the surface of the scoop about a first and a second axis thereby forming a cupped, or scoop shape. Such a construction provides a reverse thrust indicated by arrow 50 and a lateral thrust indicated by arrow 52 to watercraft 10 when steering nozzle 20 directs a flow into first scoop 42 of reverse gate 22. Second scoop 44 also extends from apex 46 to an opening 54 which directs a flow therethrough toward a center axis 56 of watercraft 10 and imparts a lateral thrust indicated by arrow 58 thereon. Lateral thrust 58 is generally smaller in magnitude than that of lateral thrust 52 when steering nozzle 20 is oriented perpendicular to reverse gate 22.

Figure 5:
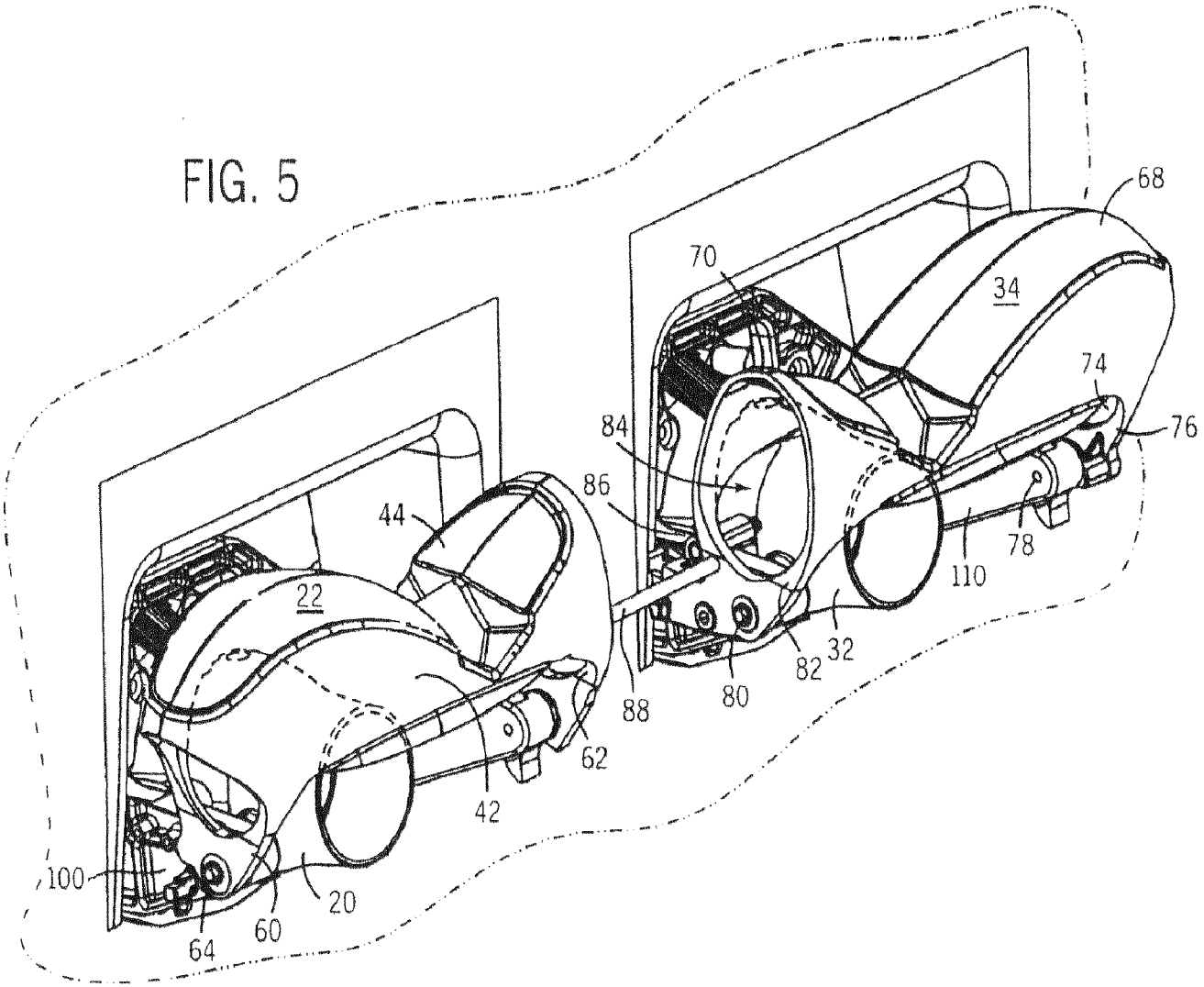
FIG. 5 is a perspective view of the jet assembly shown in FIG. 1 with the reverse gates rotated upward.

Reverse gate 22 includes a first mounting arm 60 about opening 48 and a second mounting arm 62 about opening 54 which are constructed to pivotally connect reverse gate 22 to watercraft 10. A first pivot pin 64 and a second pivot pin 66 connect first mounting arm 60 and second mounting arm 62 of reverse gate 22 to watercraft 10 such that reverse gate 22 can be rotated from a position directly aft steering nozzle 20, as shown in FIG. 1, and to a position above steering nozzle 20 and out of the way of a flow discharged therefrom, as shown in FIG. 5.

It should be apparent from FIG. 1 that the construction of reverse gate 34 of jet assembly 16 is substantially similar to reverse gate 22 and secured to watercraft 10 in a generally mirrored relationship. Reverse gate 34 includes a first scoop 68, a second scoop 70, and an apex 72, or divider, formed therebetween. First scoop 68 includes an opening 74 and a mounting arm 76 formed thereabout connected to watercraft 10 at first pivot pin 78. A second pivot pin 80 connects a control and mounting arm 82 of reverse gate 34 to watercraft 10 by extending about an opening 84 of second scoop 70 of reverse gate 34. Reverse gate 34 includes a control linkage 86 attached thereto and controlled by an operator. Control linkage 86 is used to establish the position of reverse gate 34 relative to steering nozzle 32. A linkage member 88 connects reverse gate 34 to reverse gate 22 such that rotation of reverse gate 34 by control linkage 86 also rotates reverse gate 22 relative to steering nozzle 20 and watercraft 10. Such a construction allows a single control linkage to control the position of both reverse gates 22 and 34 relative to steering nozzles 20 and 32. It is understood that having a single control linkage is shown by way of example and it is disclosed that each of the reverse gates could, if desired, have individual control linkages rather than a linking member therebetween.

Therefore, when an operator desires watercraft 10 to travel in a generally forward direction, reverse gates 22 and 34 are rotated out of the way of a flow from steering nozzles 20 and 32 and when an operator desires watercraft 10 to travel in a neutral to reverse direction, reverse gates 22 and 34 are rotated into the flow from steering nozzles 20 and 32 and thereby subjects watercraft 10 to the thrusts associated with the arrows 50, 52, and 58.

Figure 2:
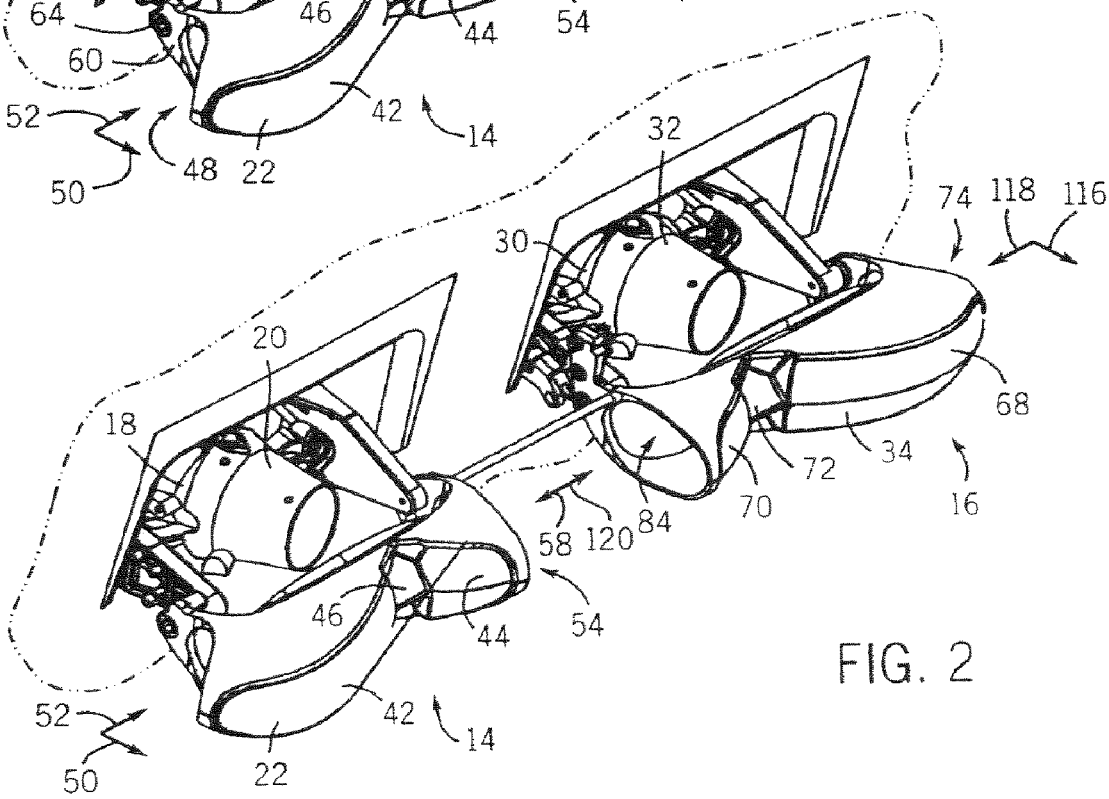
FIG. 2 is a perspective view of the jet assembly shown in FIG. 1 with the steering nozzles directed to one side thereof.

FIG. 2 shows jet assemblies 14, 16 with steering nozzles 20, 32 directed to one side of reverse gates 22, 34, respectively. Reverse gate 22 is rotated into the flow from steering nozzle 20 such that a majority of the flow thereinto is directed into second scoop 44 and discharged from outlet 54. A majority of the flow from steering nozzle 32 of jet assembly 16 is directed into first scoop 68 of reverse gate 34 and discharged therefrom at outlet 74. As will be discussed in reference to FIG. 4, it should be apparent that such an orientation of steering nozzles 20, 32 relative to reverse gates 22, 34 provides a cumulative thrust to watercraft 10 such that watercraft 10 travels in a generally port reverse direction. It should also be apparent that the orientation of the steering nozzles 20, 32 to the reverse gates 22, 34 shown in FIG. 1 provides a cumulative reverse thrust to watercraft without a lateral component such that watercraft 10 travels in a generally reverse direction. This distinction will be discussed further in reference to FIGS. 3 and 4.

Figure 3:
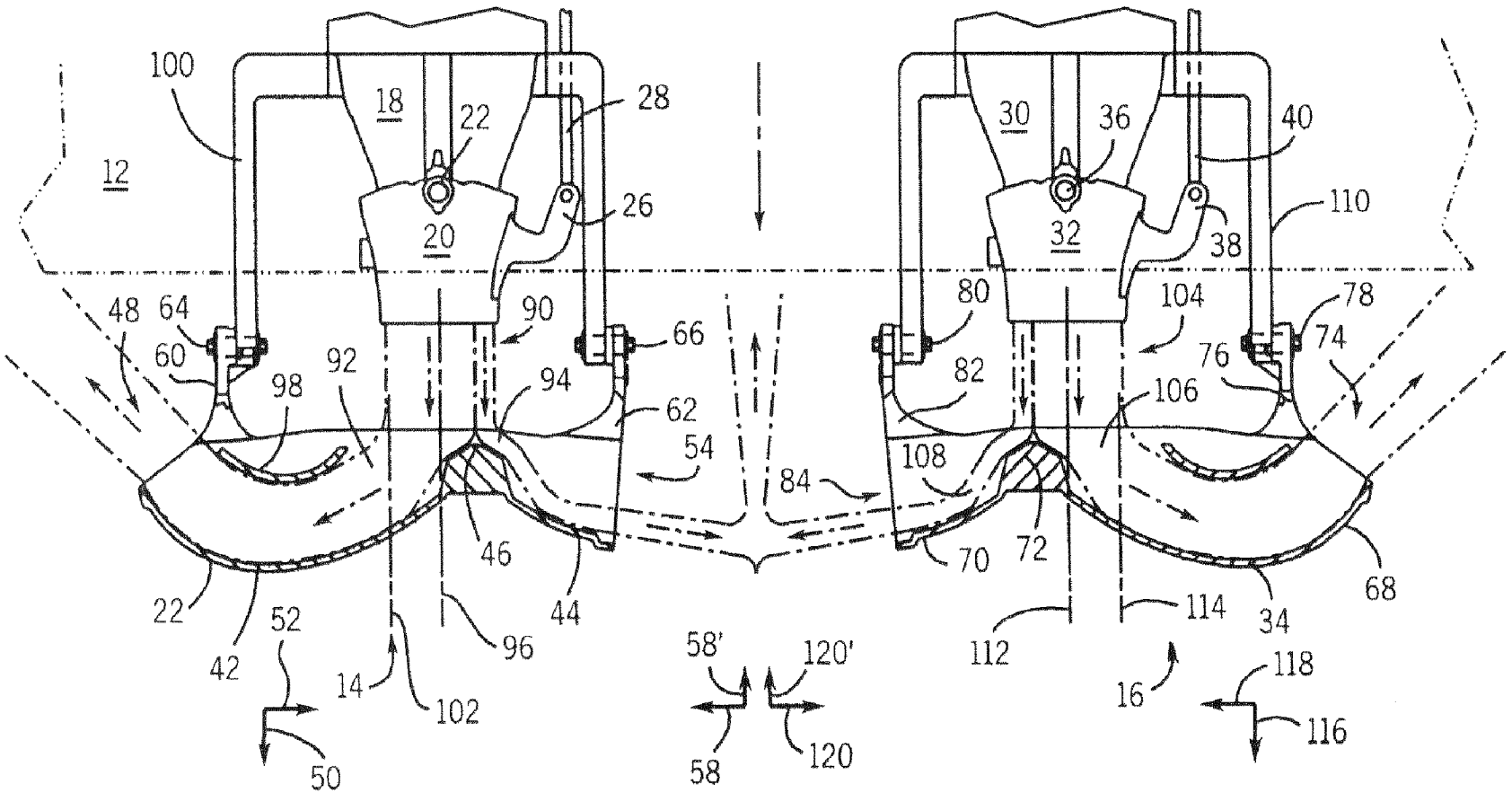
FIG. 3 is a top cross-sectional view of the jet assembly shown in FIG. 1.

FIG. 3 shows the generally reverse thrust orientation of steering nozzles 20, 32 relative to reverse gates 22, 34. Steering nozzle 20 discharges a flow 90 into reverse gate 22 which divides flow 90 into a first flow 92 and a second flow 94 at divider or apex 46. The proportional relationship between first flow 92 and second flow 94 is controlled by the distance apex 46 is offset from a center axis 96 of steering nozzle 20. That is, if apex 46 were aligned with center axis 96, equal proportions of flow 90 would travel into first scoop 42 and second scoop 44. However, such a construction would not provide the type of control achieved with the offset flow proportions set forth by the present inventions.

First flow 92 flows over first scoop 42 and behind an inner scoop 98 and is discharged at opening 48 of reverse gate 22. The purpose of inner scoop 98 will be discussed in further detail with reference to FIG. 4 and more completely shown in FIG. 6. Second flow 94 flows across second scoop 44 and is discharged therefrom at opening 54. A mounting bracket 100 attaches reverse gate 22 to watercraft 10 such that reverse gate 22 is rotatable relative thereto, as shown in FIG. 5. Additionally, mounting bracket 100 is constructed such that steering nozzle 20 is rotatable therebetween, as shown by comparing the position of the steering nozzles in FIGS. 3 and 4. Such a construction provides for the independent positioning of both reverse gate 22 and steering nozzle 20 relative to watercraft 10. Apex 46 is also offset from a center axis 102 of reverse gate 22 such that the length of first scoop 42, which extends from apex 46 to opening 48, is longer than the length of second scoop 44, which extends from apex 46 to opening 54, although in an opposite direction therefrom.

Referring now to jet assembly 16 shown in FIG. 3, reverse gate 34 is substantially a mirror construction of reverse gate 22 of jet assembly 14. Steering nozzle 32 discharges a flow 104 towards reverse gate 34 which is divided at apex 72 into a first flow 106 and a second flow 108. First flow 106 flows across first scoop 68 of reverse gate 34 and is discharged at opening 74 while second flow 108 flows across second scoop 70 and is discharged at opening 84. Reverse gate 34 is attached to a mounting bracket 110 and is rotatable out of flow 104 about first pivot pin 78 and second pivot pin 80. Additionally, apex 72 also is offset from both a center axis 112 of steering nozzle 34 and a center axis 114 of reverse gate 34.

First flow 106 exits first scoop 68 of reverse gate 34 and generates a reverse thrust indicated by arrow 116 and a lateral thrust indicated by arrow 118 while second flow 108 exits second scoop 70 through opening 84 and generates a lateral thrust indicated by arrow 120. The combined effects of thrusts 50, 52, and 58 from reverse gate 22 and thrusts 116, 118, and 120 from reverse gate 34 is to propel watercraft 10 in a generally reverse direction when center axes 96, 112 of steering nozzles 20, 32 are parallel to center axes 102, 114 of reverse gates 22, 34, respectively. Additionally, it is within the scope of the present claims that second scoops 44 and 70 be constructed to also provide a generally reverse thrust to watercraft 10 by a modification of the outlet at openings 54 and 84 to generate a more forward directed discharge. One skilled in the art will now readily understand that many modifications could be undertaken, yet still obtain the same function of two offset flow paths.

A neutral thrust of watercraft 10 is achieved by rotating reverse gate 22 partially into flows 90, 104 discharged from steering nozzles 20, 32 such that a reverse thrust generated by reverse gates 22, 34 substantially matches a forward thrust generated by a portion of flows 90, 104 that does not impinge on reverse gate 22 or 32. Additionally, it is understood that first scoops 42, 68 generate both a reverse and a lateral thrust whereas second scoops 44, 70 primarily generate a lateral thrust that augments the lateral thrust generated by first flows 48, 74. Second flows 94 and 108 also generate a forward thrust, indicated generally by arrows 58' and 120', which negates a portion of reverse thrusts 50 and 116. Simply, first scoops 42, 34 contribute to both reverse and lateral thrusts whereas, second scoops 44, 70, primarily contribute only to lateral, or steering thrusts of watercraft 10.

Figure 4:
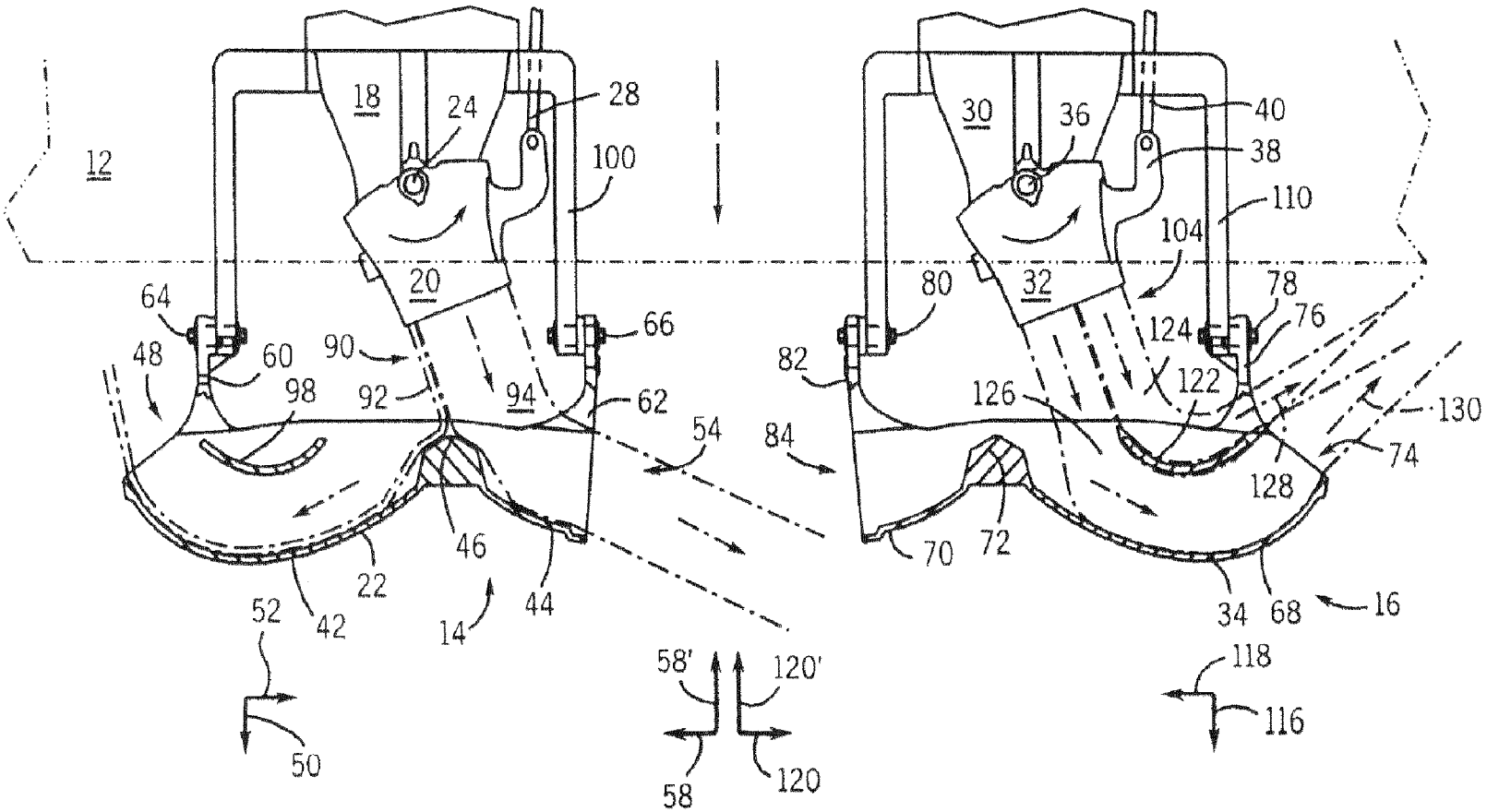
FIG. 4 is a top cross-sectional view of the jet assembly shown in FIG. 2.

FIG. 4 shows a "steered reverse" accomplished through rotation of the steering nozzles relative to the reverse gates. In FIG. 4, steering nozzles 20, 32 are turned toward the starboard side of watercraft 10. Steering nozzle 20 directs a majority of flow 90 toward second scoop 44 of reverse gate 22. Flow 92 across first scoop 42 is substantially less than flow 94 across second scoop 44. As such, the magnitude of thrust 58 is maximized while thrust 50 and thrust 52 are substantially reduced. Additionally, due to the increase in flow 94 across second scoop 44, the magnitude of thrust 58', although proportionally smaller than thrust 58, is increased. Flow 94 exits second scoop 44 of reverse gate 22 at opening 54 and passes behind second scoop 70 of reverse gate 34 of jet assembly 16.

Steering nozzle 32 of jet assembly 16 directs the majority of flow 104 into first scoop 68. No flow from steering nozzle 32 flows into second scoop 70 of reverse gate 34 so that thrusts 120 and 120' are approximately zero. Flow 104 is no longer divided by apex 72, but is divided by an inner scoop 122 into a first flow 124 and a second flow 126. First flow 124 is impinged on inner scoop 122 and exits reverse gate 34 at opening 74 in a first direction 128 while second flow 126 passes between inner scoop 122 and first scoop 68 of reverse gate 34 and also exits at opening 74, but in a second direction 130. As shown by discharge directions 128, 130 of flow 124 and 126, directing a portion of the flow 104 along direction 128 from steering nozzle 32 over inner scoop 122 provides an increase in the lateral thrust 118 generated by reverse gate 34.

Summing the thrust components 50, 52, 58, and 58', generated from reverse gate 22, with the thrust components 116, 118, 120, and 120', generated from reverse gate 34, causes watercraft 10 to propel in a generally port reverse direction. As such, having the steering nozzles independently positionable relative to not only the position of the reverse gate, but the inner scoop formed therein, provides an operator with improved control over the generally reverse operation of the watercraft.

FIG. 5 shows reverse gates 22 and 34 rotated out of the path of a discharge from the steering nozzles 20 and 32. Such a positioning of the reverse gates allows the general direction of the discharge from steering nozzles 20 and 32 to control the direction of travel of watercraft 10. That is, as shown in FIG. 5, when the reverse gates 22 and 34 are rotated out of the flow from the steering nozzles 20 and 32, watercraft 10 is directed in a generally steered forward direction. As reverse gates 22, 34 are rotated into flows 90, 104 discharged from steering nozzles 20, 32, watercraft 10 can achieve a neutral propulsion when the forward thrusts generated by the flow that bypasses the reverse gate substantially matches the reverse thrusts generated by reverse gates 22, 34.

Figure 6:
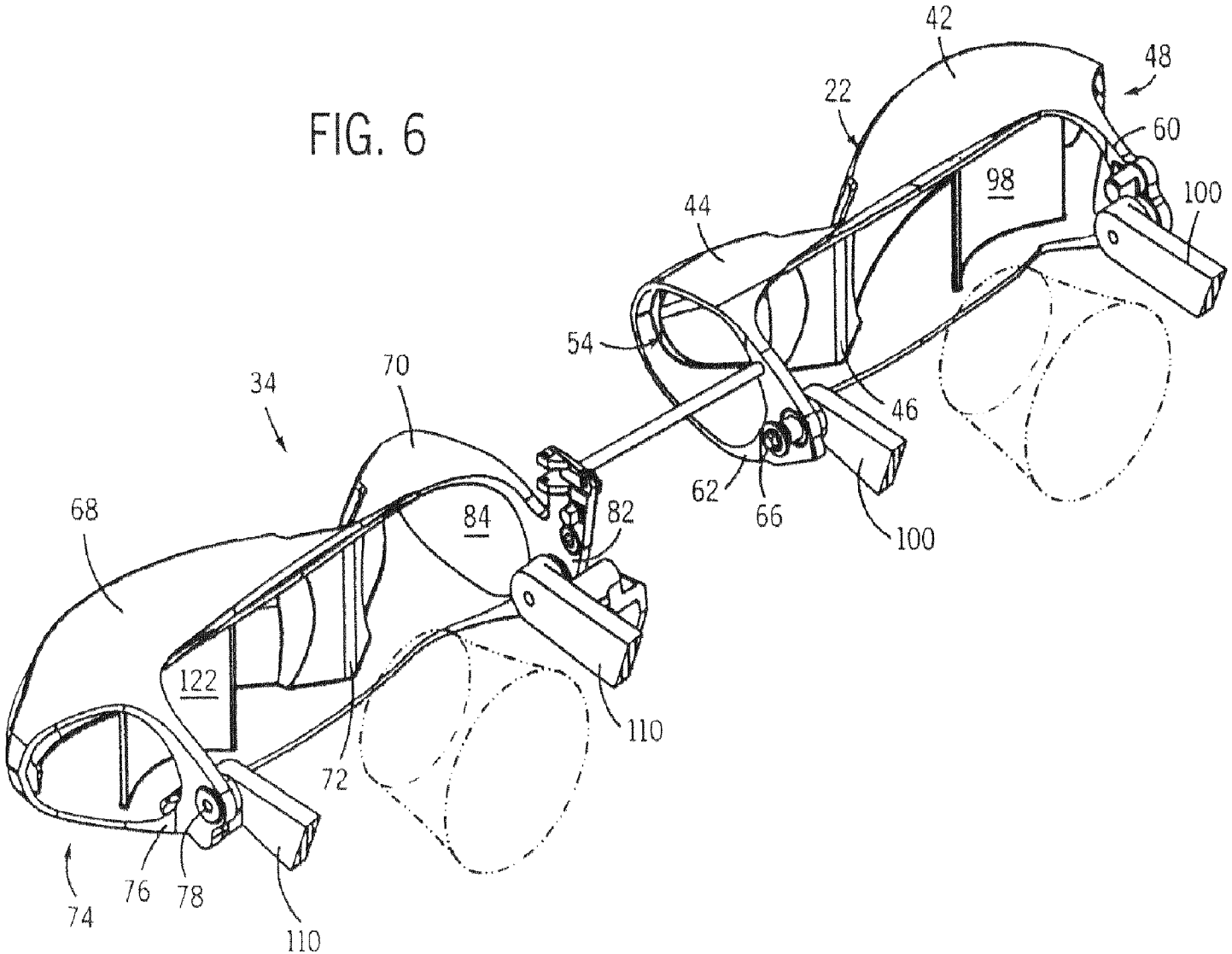
FIG. 6 is a perspective view of the inner surface of reverse gates of a portion of the jet assembly shown in FIG. 1.
Figure 7:
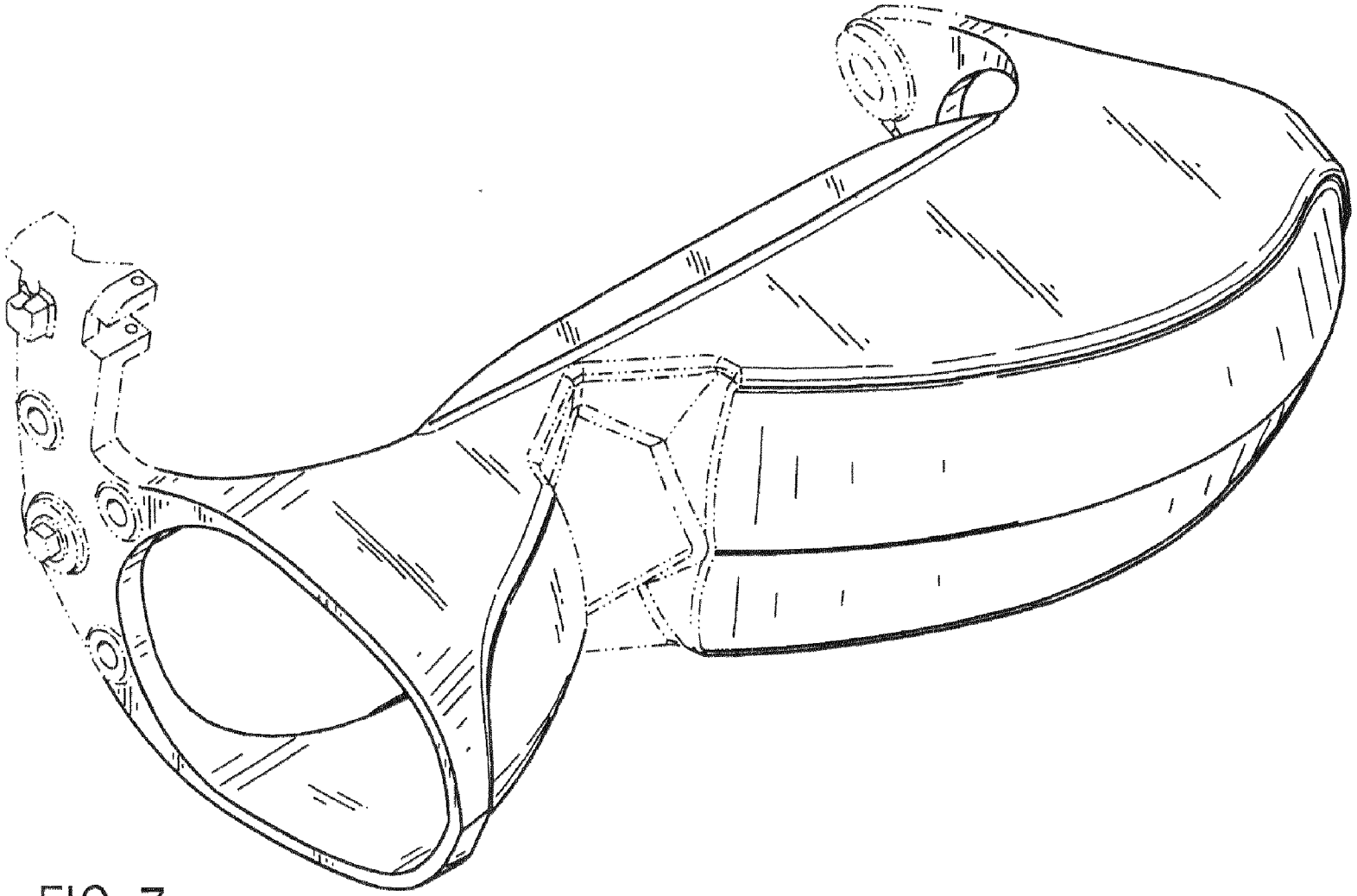
FIG. 7 is a front perspective view of a reverse gate for a watercraft in accordance with the present invention.
Figure 8:
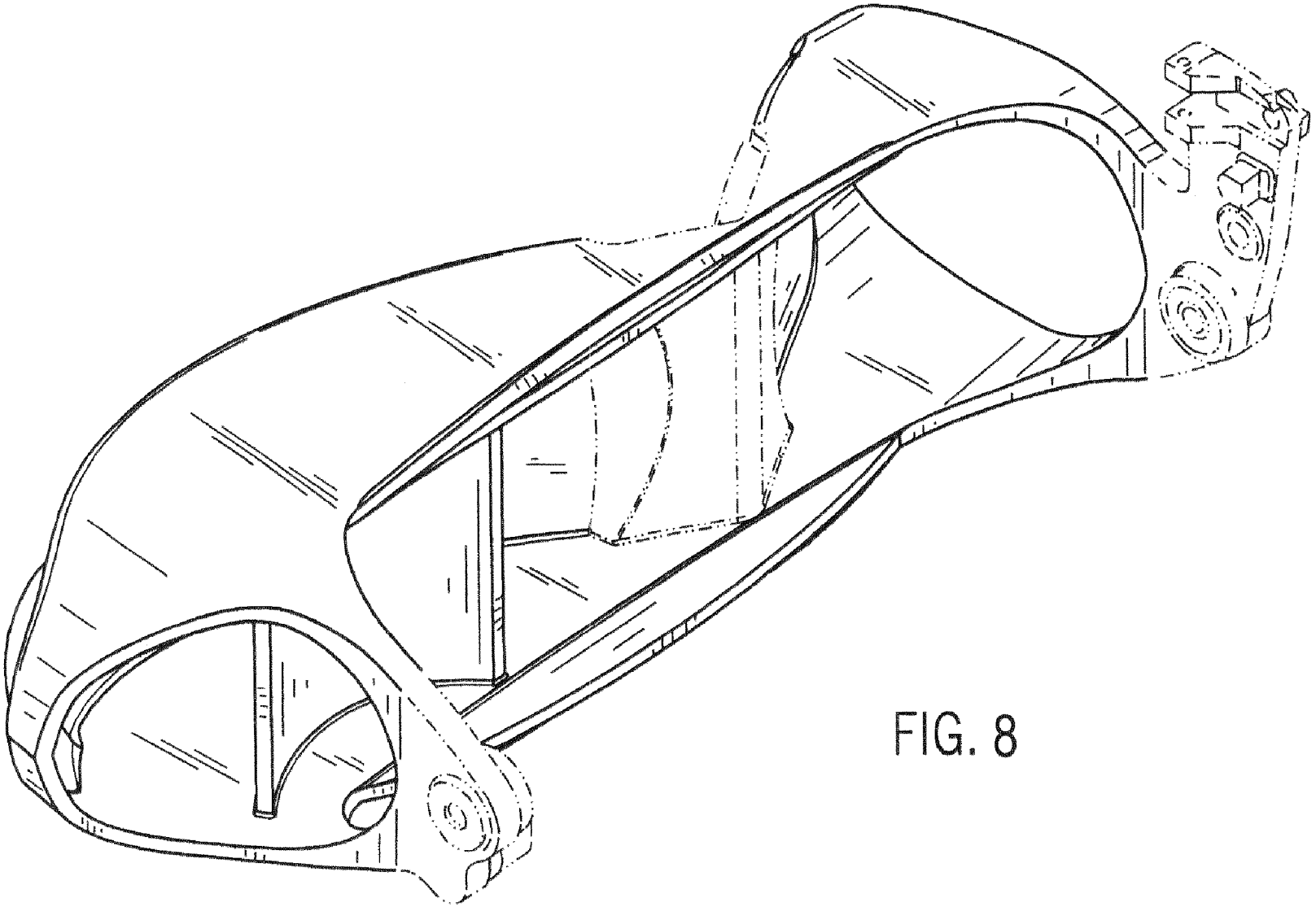
FIG. 8 is a rear perspective view of the reverse gate for a watercraft of FIG. 7.
Figure 9:
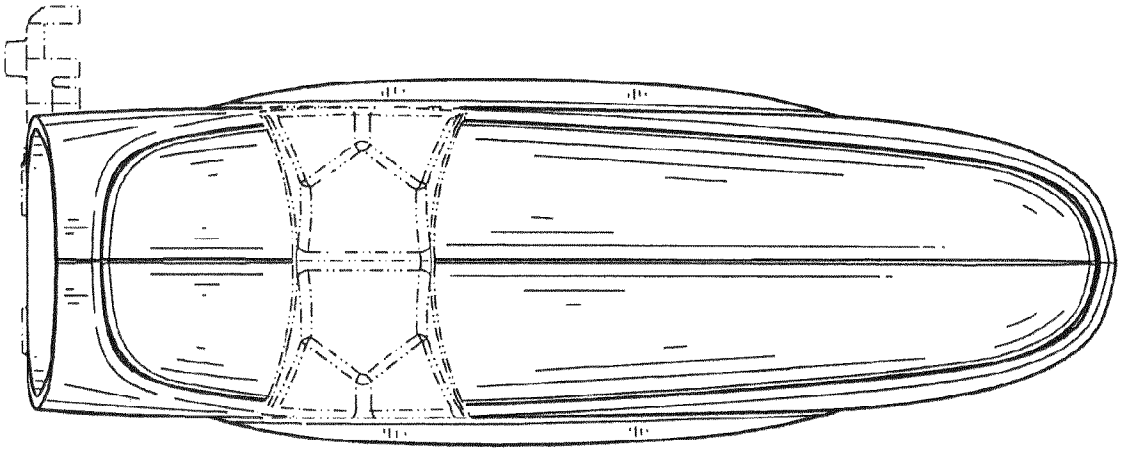
FIG. 9 is a front elevational view of the reverse gate for a watercraft of FIG. 7.
Figure 10:
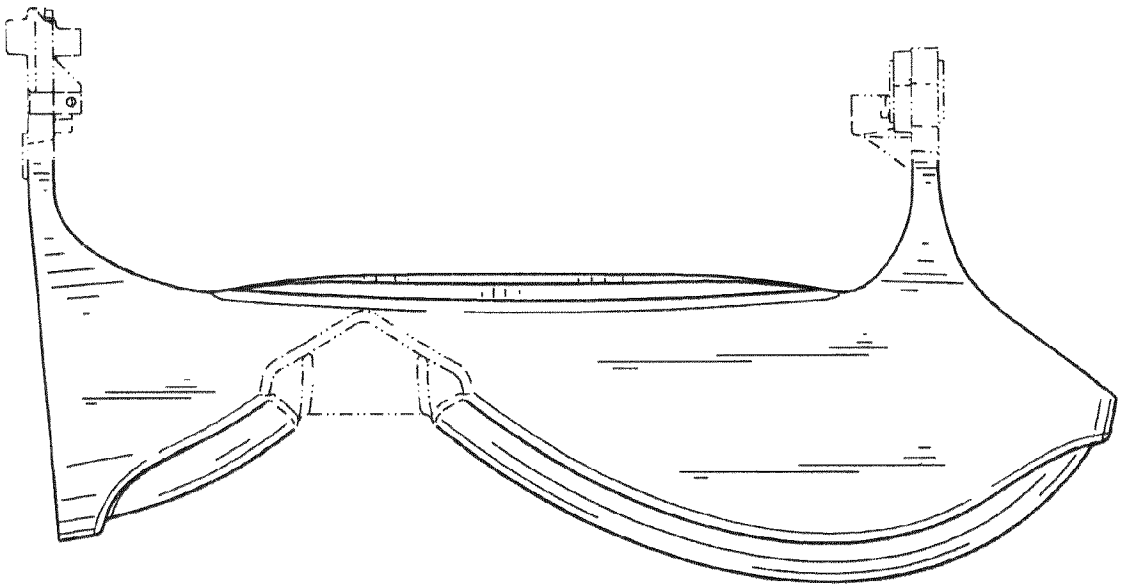
FIG. 10 is a top plan view of the reverse gate for a watercraft of FIG. 7.
Figure 11:
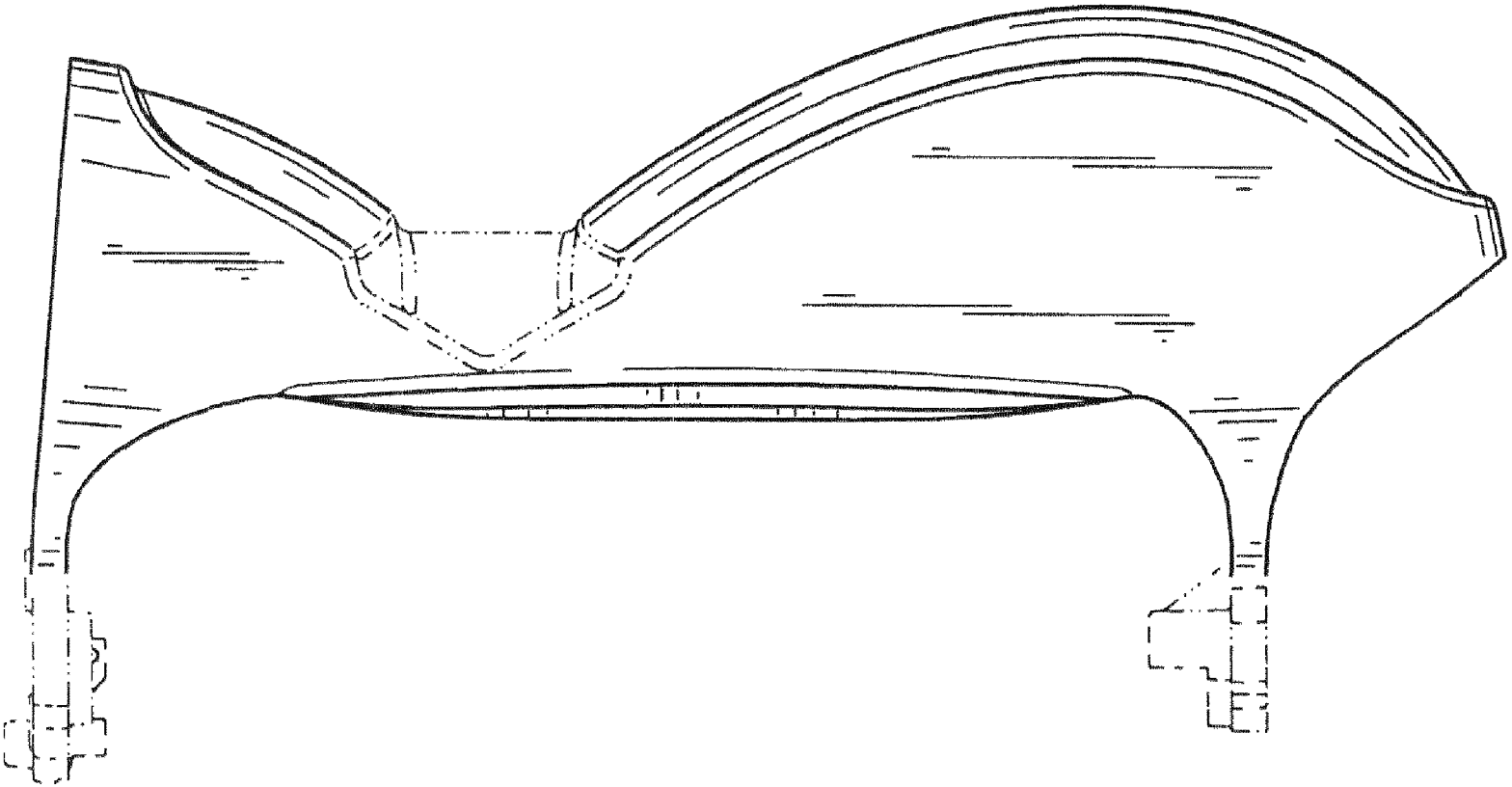
FIG. 11 is a bottom plan view of the reverse gate for a watercraft of FIG. 7.
Figure 13:
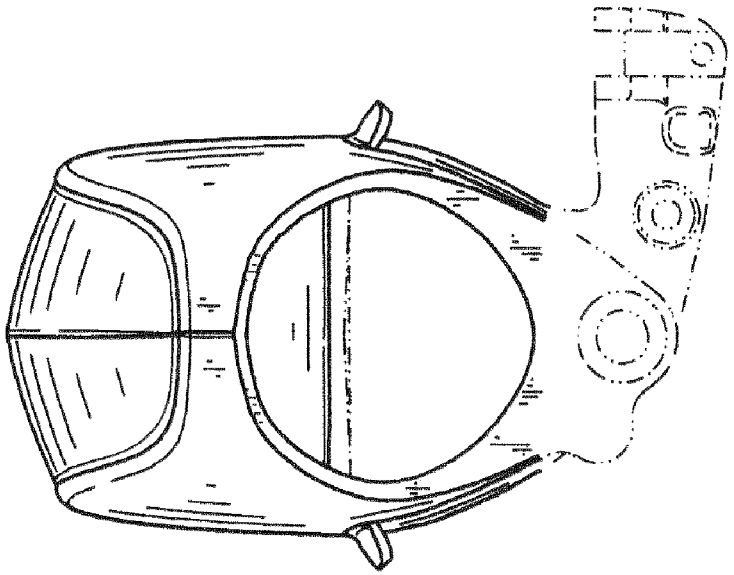
FIG. 13 is a right side elevational view of the reverse gate for a watercraft of FIG. 7.
Figure 12:
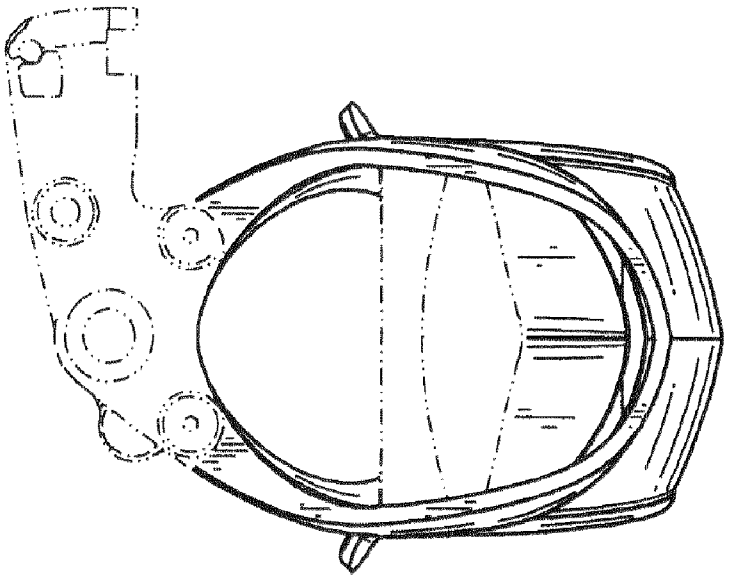
FIG. 12 is a left side elevational view of the reverse gate for a watercraft of FIG. 7.
Figure 14:
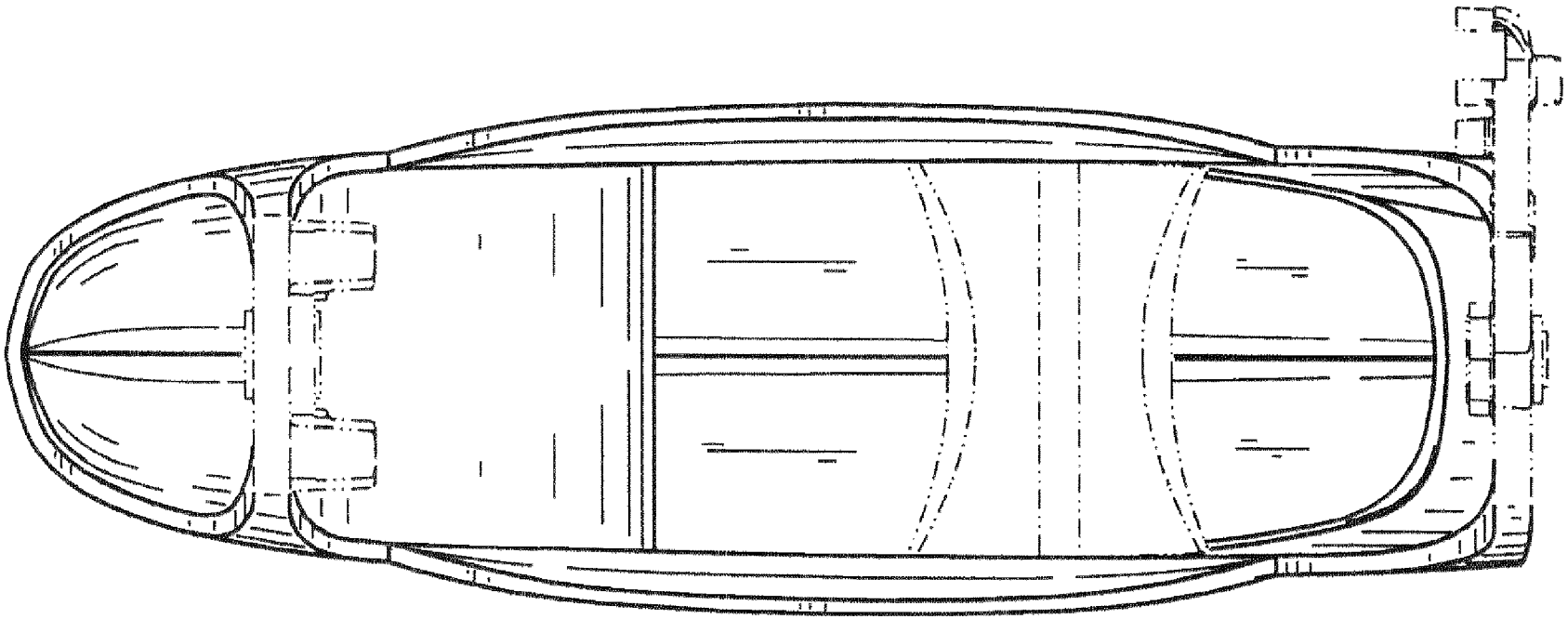
FIG. 14 is a rear elevational view of the reverse gate for a watercraft of FIG. 7.

FIG. 6 shows the inside surface of the reverse gates 22 and 34. Inner scoop 98 of reverse gate 22 is located inside first scoop 42. Inner scoop 122 of reverse gate 34 is located inside first scoop 68 of reverse gate 34. It should be apparent that the inside surfaces of the respective reverse gates are substantially mirror images of one another. When a steering nozzle directs flow into reverse gate 22, the flow can either be directed partially into first scoop 42 and partially across inner scoop 98, entirely into first scoop 42 and not across inner scoop 98, partially across first scoop 42 and partially across second scoop 44, or entirely across second scoop 44. The division of the flow of water across the reverse gate is controlled by the position of the steering nozzle relative to the reverse gate. It should be understood that the mirror-like orientation of reverse gate 22 to reverse gate 34 in addition to the unsymmetrical construction of the reverse gates, generates cooperating lateral thrusts from the reverse gates.

Therefore, in accordance with one embodiment of the present invention, a reverse gate includes a first scoop having an inlet and an outlet and a second scoop also having an inlet and an outlet. The inlet of the first scoop intersects the inlet of the second scoop and forms an apex thereat. The apex is offset from a center of the reverse gate and thereby discharges a proportional amount of the water that impinges thereupon from a steering nozzle.

In accordance with another embodiment of the present invention, a reverse gate assembly for a watercraft includes a steering nozzle pivotably attached to the watercraft and having a center axis therethrough. The reverse gate includes a first curved section and a second curved section attached thereto. A divider is positioned between the first and the second curved sections and is offset from the center axis of the steering nozzle.

In accordance with a further embodiment of the present invention, a jet-propulsion system of a watercraft includes a steering nozzle rotatably attached to a first outlet. A reverse gate is attached to the first outlet and has an apex that is offset from a midpoint of the reverse gate and a center of the steering nozzle.

In accordance with yet another embodiment of the present invention, a method of providing a steering control to a watercraft is disclosed which includes, providing a reverse gate in a flow from a steering nozzle, separating the flow across the reverse gate into a first and second flow, and directing the first flow in a direction generally opposite to the flow from the steering nozzle when the steering nozzle is generally perpendicular to the reverse gate and redirecting the second flow in a second direction generally perpendicular to the flow from the steering nozzle and; wherein the first flow is generally greater than the second flow when the steering nozzle is generally perpendicular to the reverse gate.

In accordance with a further embodiment of the present invention, a reverse gate includes a first scoop having an inlet and an outlet and a second scoop also having an inlet and an outlet. The inlet of the first scoop intersects the inlet of the second scoop and forms an apex thereat. A mounting arrangement mounts the reverse gate about a nozzle so that the apex of the reverse gate is offset relative to the nozzle that the reverse gate is mounted to. Such a construction divides a flow impinged on the reverse gate into a first, lateral and reverse, component and a second, primarily lateral, component.

The present invention has been described in terms of the preferred embodiment, and it is recognized that equivalents, alternatives, and modifications, aside from those expressly stated, are possible and within the scope of the appending claims.

What is claimed is:

1. A reverse gate assembly for a watercraft comprising:

a steering nozzle having a center axis and pivotably attached to a watercraft;

a reverse gate having a first curved section, a second curved section attached to the first curved section, and a third curved section within the first curved section;

a divider extending outwardly from the reversed gate between the first and the second curved sections; and wherein the divider is offset from the center axis of the steering nozzle.

2. The assembly of claim 1 wherein the first curved section is longer than the second curved section and the divider is an apex.

3. The assembly of claim 1 wherein the divider is offset from a pivot axis of the steering nozzle such that more of a discharge from the steering nozzle is directed onto the first curved section than onto the second curved section when the center axis of the steering nozzle is generally parallel to a center line of the watercraft.

4. The assembly of claim 1 further comprising a stator nozzle located in front of the steering nozzle and having the reverse gate attached thereto.

5. The assembly of claim 1 further comprising a first bracket attached to each of the first and second curved sections and constructed to pivotally attach the reverse gate to the watercraft at a position forward of the steering nozzle.

6. The assembly of claim 1 incorporated into a watercraft having at least two sources of propulsion.

7. A jet propulsion system for a watercraft comprising:

first and second jet-propulsion outlets;

a first and second steering nozzles, each having a center and rotatably attached to a respective one of the first and second jet-propulsion outlets;

a first and second reverse gates, each having a midpoint and an apex, a first, a second, and a third curved sections, and attached to a respective one of the first and second jet-propulsion outlets;

wherein the apex of the first and second reverse gates is offset from the respective midpoint and the center of the respective steering nozzles, and wherein the third curved section is contained within the first curved section.

8. The system of claim 7 wherein the steering nozzles are rotatable relative to the first and second jet-propulsion outlets and the first and second reverse gates.

9. The system of claim 7 wherein the first and second reverse gates each further comprise a pair of mounting brackets constructed to engage a pivot pin.

10. The system of claim 7 wherein the first and second reverse gates each has a variable vertical position relative to the steering nozzle.

11. The system of claim 7 wherein the first and second reverse gates are substantially mirror images of each other when connected to a watercraft.

12. A method of providing steering control to a watercraft comprising:

providing a reverse gate in a flow from a steering nozzle;

separating the flow across the reverse gate into a first and second flow;

redirecting the first flow in a direction generally opposite to the flow from the steering nozzle when the steering nozzle is generally perpendicular to the reverse gate and redirecting the second flow in a second direction generally perpendicular to the flow from the steering nozzle;

wherein the first flow is greater than the second flow when the steering nozzle is generally perpendicular to the reverse gate; and providing another reverse gate and another steering nozzle wherein when the steering nozzles are directed substantially to starboard of the watercraft, the flow across the first reverse gate is not separated and the flow across the second reverse gate is separated, and when the steering nozzles are directed substantially to port of the watercraft the flow across the first reverse is separated and the flow across the second reverse sate is not separated.

13. The method of claim 12 further comprising varying the first and second flows in an inverse proportional relationship depending on a position of the steering nozzle relative to the reverse gate.

14. A method of providing steering control to a watercraft comprising:

providing a reverse gate in a flow from a steering nozzle;

separating the flow across the reverse gate into a first and second flow;

redirecting the first flow in a direction generally opposite to the flow from the steering nozzle when the steering nozzle is generally perpendicular to the reverse gate and redirecting the second flow in a second direction generally perpendicular to the flow from the steering nozzle;

wherein the first flow is greater than the second flow when the steering nozzle is generally perpendicular to the reverse gate, and wherein the step of redirecting the first flow generates a lateral component and a reverse component and the step of redirecting the second flow generates primarily a lateral component.

15. The method of claim 14 further comprising varying the first and second flows in an inverse proportional relationship depending on a position of the steering nozzle relative to the reverse gate.

16. The method of claim 14 further comprising providing a second reverse gate having a generally mirror image of the first reverse gate.

* * * * *